US005086632A

United States Patent [19]

Hsu

[11] Patent Number: 5,086,632

[45] Date of Patent: Feb. 11, 1992

[54] FLEXIBLE KEY AND LOCK ASSEMBLY

[76] Inventor: Yun-Tung Hsu, No. 9, Floor 2, Alley 2, Lane 437, Nei-Hu Rd., Sec. 1, Nei-Hu Dist., Taipei, Taiwan

[21] Appl. No.: 520,579

[22] Filed: May 8, 1990

[51] Int. Cl.[5] ..... E05B 19/08

[52] U.S. Cl. ..... 70/375; 70/397; 70/399; 70/408; 70/409; 70/453

[58] Field of Search ..... 70/456 R, 395–397, 70/399, 401, 408, 409, 453, 375

[56] References Cited

U.S. PATENT DOCUMENTS

| | | | |
|---|---|---|---|
| 507,408 | 10/1893 | Bole | 70/399 |
| 888,478 | 5/1908 | Drew | 70/399 |
| 3,605,464 | 9/1971 | Ostrager | 70/456 R X |
| 4,484,462 | 11/1984 | Berkowitz | 70/224 X |
| 4,557,123 | 12/1985 | Marks et al. | 70/456 R X |
| 4,561,271 | 12/1985 | Scharboneau | 70/409 X |

FOREIGN PATENT DOCUMENTS

| | | | |
|---|---|---|---|
| 347570 | 1/1922 | Fed. Rep. of Germany | 70/408 |
| 374673 | 4/1923 | Fed. Rep. of Germany | 70/399 |
| 414110 | 5/1925 | Fed. Rep. of Germany | 70/399 |
| 416273 | 7/1925 | Fed. Rep. of Germany | 70/399 |
| 12293 | of 1910 | United Kingdom | 70/399 |
| 27368 | of 1912 | United Kingdom | 70/399 |
| 403826 | 1/1934 | United Kingdom | 70/451 |

*Primary Examiner*—Lloyd A. Gall

*Attorney, Agent, or Firm*—Townsend and Townsend

[57] ABSTRACT

A lock assembly includes a lock body having tumbler members and a curved keyway, and a flexible key to be received in the curved keyway and having key bit projections for actuating the tumbler members. The flexible key has a degree of stiffness sufficient enough to allow said key to be inserted into said curved keyway.

19 Claims, 7 Drawing Sheets

FLEXIBLE KEY AND LOCK ASSEMBLY

BACKGROUND OF THE INVENTION

This invention relates to a lock assembly, more particularly to a lock having a curved keyway and a key which is flexible but has a degree of stiffness sufficient to allow necessary movement of the key inside the keyway in order to transmit a torque.

Personal safety and protection of property are among the primary concerns of any family. This is the reason the search for an economical and compact pickproof lock has been the ultimate goal of every locksmith.

A sectional view of a conventional mechanical padlock is shown in FIG. 1. The padlock 8 has a keyplug 81 with an axial keyway 83 and a keyhole 82 for receiving a rigid key 80. The padlock 8 has tumbler pins 84 which prevent the rotation of the keyplug 81. The key bits of the key 80 actuate the tumbler pins 84 to permit the rotation of the keyplug 81. The rotation of the keyplug 81 moves the locking member 85, thus releasing the shackle 86. The main disadvantage of this conventional padlock is that it can be easily picked by a burglar using an ordinary paper clip or any similar article.

SUMMARY OF THE INVENTION

Therefore, the objective of this invention is to provide a lock assembly that is difficult to pick.

More specifically, the objective of this invention is to provide a lock with a curved keyway and a key that is semi-rigid, making the picking of the lock with a paper clip or any similar article extremely difficult.

Accordingly, an improved lock assembly of this invention comprises a lock body having tumbler members and a curved keyway, and a flexible key to be received in the curved keyway and having key bit projections for actuating the tumbler members. The flexible key has a plurality of knuckles movably interconnected to one another to give the key a degree of stiffness sufficient to allow the key to be inserted into the curved keyway.

The proposed lock can be incorporated in a padlock, a door lock or a door knob. When incorporated in a door lock, the lock can be formed with two oppositely disposed keyholes and can be operated from either of the two keyholes.

BRIEF DESCRIPTION OF THE DRAWINGS

Other features and advantages of this invention will become apparent in the following detailed description of the preferred embodiments with reference to the accompanying drawings, in which.

DETAILED DESCRIPTION OF THE PREFERRED EMBODIMENTS

Figure 1:
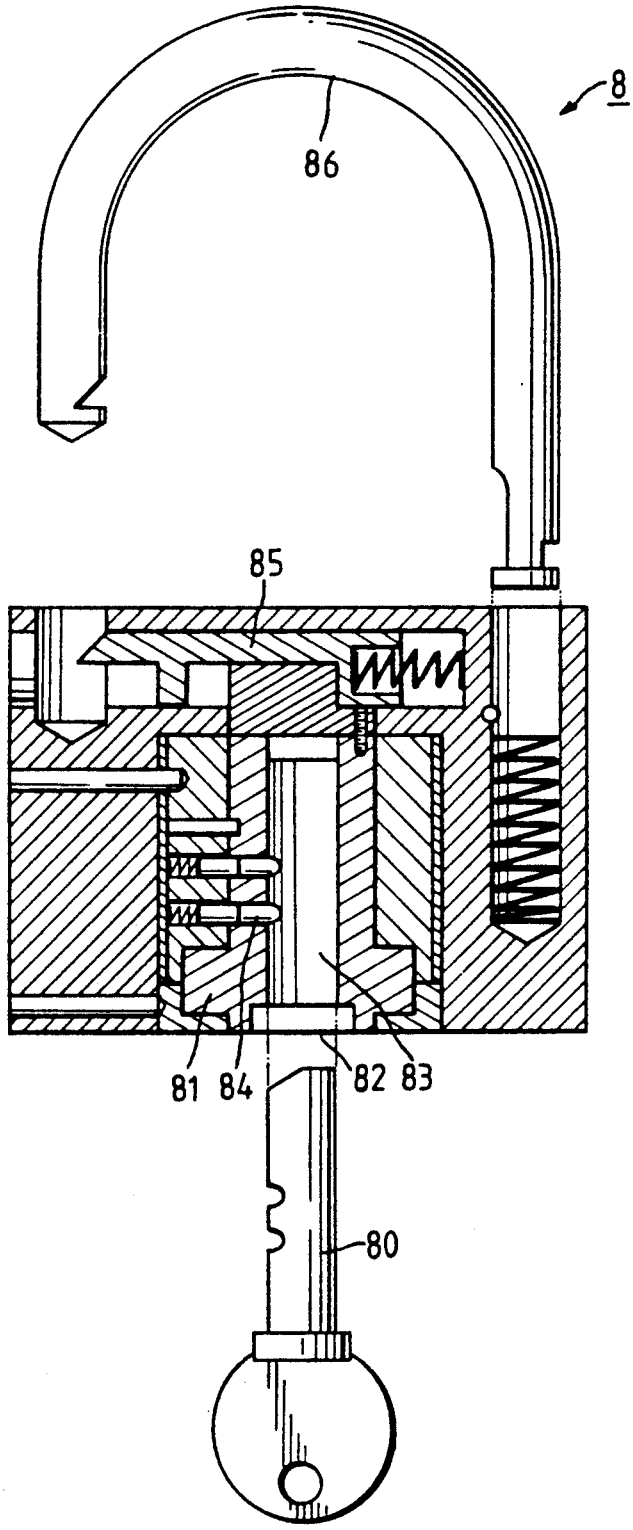
FIG. 1 PRIOR ART
FIG. 1 is a sectional view of a conventional lock assembly.
Figure 2:
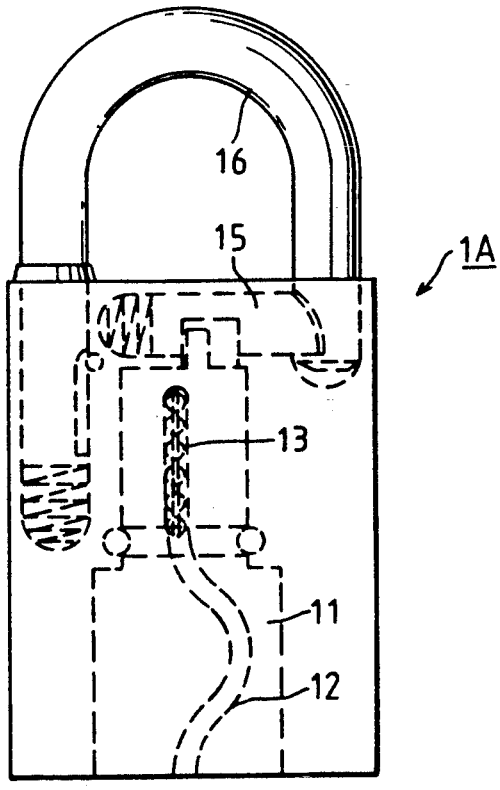
FIG. 2 is a schematic sectional view of a first preferred embodiment of a lock according to this invention.

A schematic sectional view of a first preferred embodiment of a lock according to this invention is shown in FIG. 2. The lock 1A is a padlock having a keyplug 11 with a curved keyway 12. A plurality of tumbler pins 13 is provided in the lock 1A in a conventional manner and project into the keyway 12.

Figure 3A:
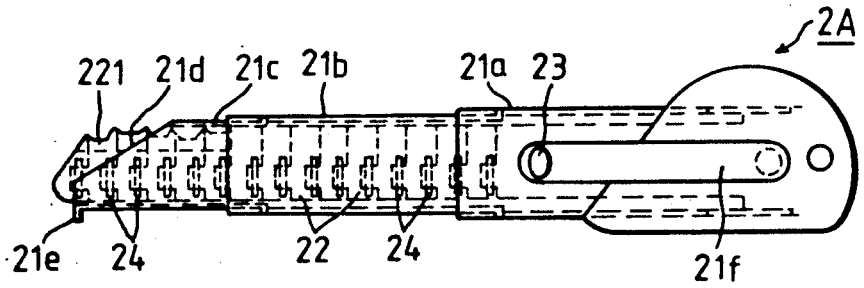
FIGS. 3A and 3C are illustrations of a first and a second preferred embodiment of a flexible key for a lock of this invention.
Figure 3B:
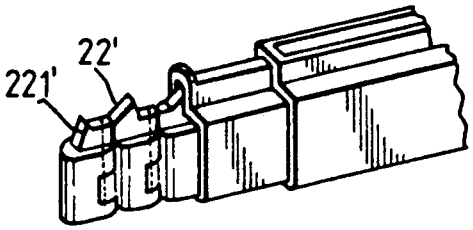
FIG. 3B is a second example of a knuckle arrangement for the flexible key of FIG. 3A.

A first preferred embodiment of a key for the lock 1A according to this invention is shown in FIGS. 3A and 3B. The key 2A has a hollow head portion **21*a* with two hollow sections 21*b* and 21*c* telescopically connected thereto. The head portion 21*a* and the hollow sections 21*b* and 21*c* are rectangular in cross-section. The body of the key 2A is formed as a plurality of knuckles 22 hinged to one another by hinge pins 24. The knuckles 22 are slidably attached to the head portion 21*a* and are contained by the hollow sections 21*b* and 21*c*. As shown in FIG. 3B, the knuckles 22 adjacent to an outermost end of the key 2A have recesses that form key bit projections 221 which match with the tumbler pins 13. The innermost hollow section 21*c* has inclined edges 21*d* which expose the key bit projections 221 of the key 2A. The hollow section 21*c* has a flange tip 21*e* which is used for pulling the hollow section 21*c* away from the head portion 21*a*. The hollow sections 21*b* and 21*c* thus serve as a protective cover and guide for the body of the key 2A. The head portion 21*a* has an elongated groove 21*f*. The endmost knuckle 22 disposed at a position closest to the head portion 21*a* has a protruding button 23 slidably extending along the elongated groove 21*f*. When the key 2A is not in use, the protruding button 23 is moved to a headmost extreme end of the elongated groove 21*f* in order to pull the knuckles 22 inward. The flange tip 21*e* is then pulled outward, causing the hollow sections 21*b* and 21*c* to cover the knuckles 22. When using the key 2A, the protruding button 23 is moved to the opposite extreme end of the elongated groove 21*f* to extend the knuckles 22 away from the hollow sections 21*b*, and 21*c*. The endmost knuckle 22 at the outermost end of the key 2A is then inserted into the keyhole 14 of the lock 1A. The hinge pins 24 allow the key 2A to bend so that the body of the key 2A can move along the keyway 12. The hollow sections 21*b* and 21*c* do not enter the keyway 12 since they are forced to retract into the head portion 21*a* by the action of pushing the key 2A into and against the lock 1A. The flange tip 21*e* extends outside the head portion 21*a* when the hollow sections 21*b* and 21*c* are retracted into the head portion 21*a*. The knuckles 22 provide the key 2A with the necessary degree of stiffness required to transmit torsion to the keyplug 11 so that the locking member 15 can be moved away from the shackle 16 when unlocking the padlock 1A**.

FIG. 3B shows a second example of a knuckle arrangement for the key 2A of this invention. The knuckles 22' each have a substantially wedge-shaped projection 221' which serve as the key bit projections.

Figure 3C:
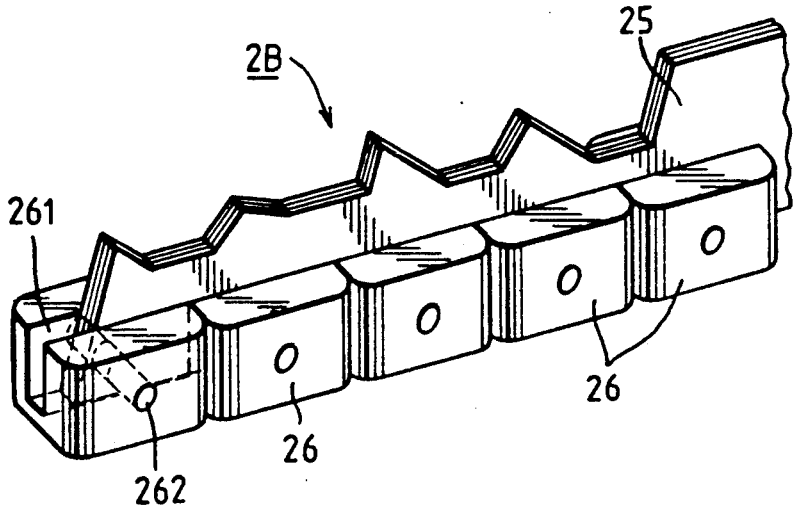

Referring to FIG. 3C, a second preferred embodiment of a key 2B for the lock 1A of this invention is shown to have a key bit portion 25 made of a flexible material. The key bit portion 25 has a level base end fixed by pins 262 in longitudinal grooves 261 of a plurality of aligned rectangular knuckles 26. The rectangular knuckles 26 provide the key 2B with the degree of stiffness required to transmit torsion to the keyplug 11.

Figure 4:
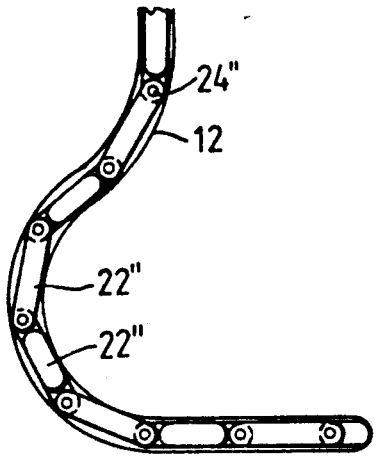
FIG. 4 is a schematic view illustrating a flexible key received in the keyway of a lock according to this invention.

FIG. 4 is a schematic view of still another example of a knuckle arrangement for a flexible key received into the keyway of a lock according to this invention. The knuckles 22'' are shown to be hinged to one another by hinge pins 24''.

Figure 5A:
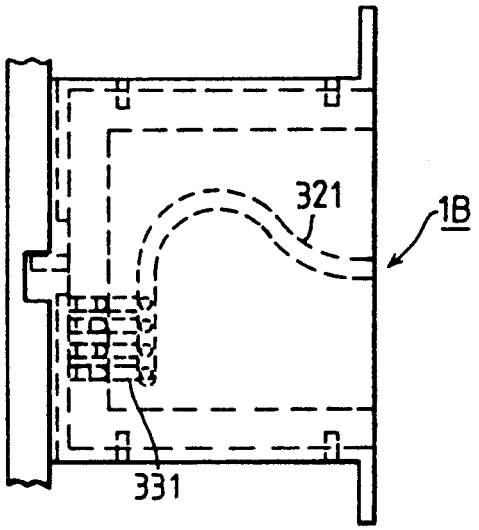
FIGS. 5A, 5B, and 5C are schematic sectional illustrations of second, third and fourth preferred embodiments of a lock according to this invention.
Figure 5B:
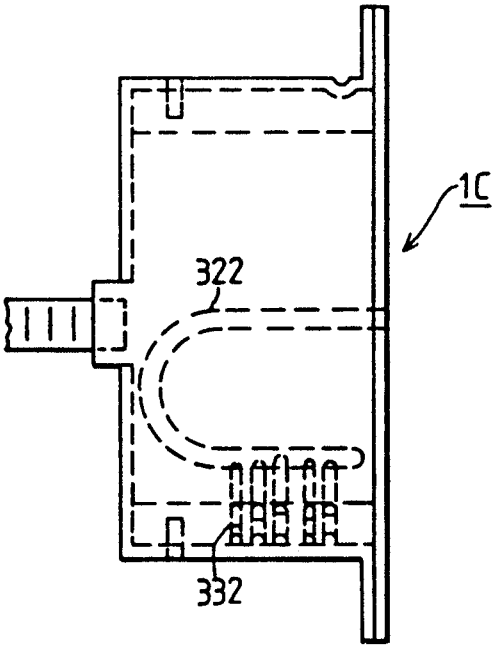
Figure 5C:
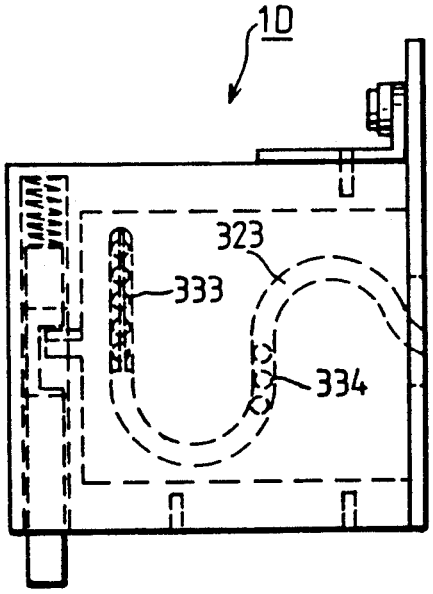

FIGS. 5A, 5B, and 5C are schematic sectional views of second, third and fourth preferred embodiments of a lock according to this invention. The locks 1B, 1C and 1D are door locks having keyways 321, 322 and 323 of different shapes and lengths. The position of the tumbler pins 331, 332, 333 and 334 may also be varied depending upon the shape of the keyway. As shown in FIG. 5C, the lock 1D may have more than one group of tumbler pins 333 and 334 to make the lock 1D more difficult to pick.

Figure 6C:
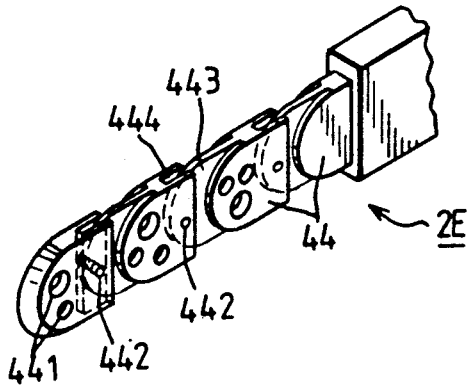
FIGS. 6A, 6B, and 6C are illustrations of third, fourth and fifth preferred embodiments of a flexible key for a lock according to this invention.
Figure 6A:
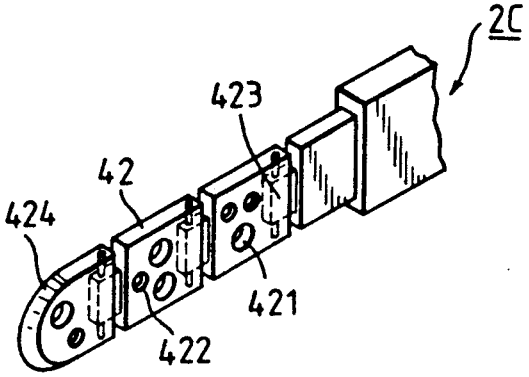
Figure 6B:
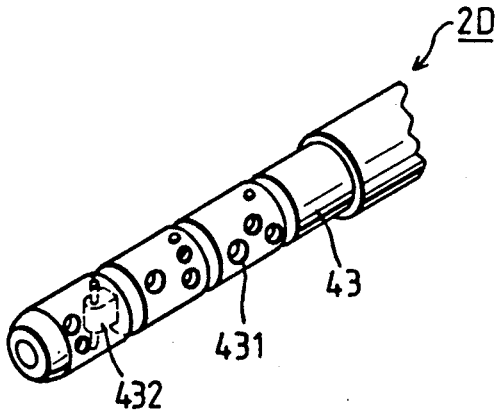

FIGS. 6A, 6B and 6C are third, fourth and fifth embodiments of a key for the locks of this invention. The body of the key 2C, which is illustrated in FIG. 6A, comprises a plurality of longitudinally aligned rectangular plates 42 and an endmost substantially semi-circular plate 424 with a curved edge that is to be inserted in the keyhole. The rectangular plates 42 and the endmost plate 424 are joined to one another by hinge pins 423. The surfaces of the rectangular plates 42 and the endmost plate 424 are formed with a plurality of recesses 421 and 422 having different sizes and depths which are used for actuating the tumbler pins of the lock.

The body of the key 2D, as illustrated in FIG. 6B, comprises a plurality of axially aligned hollow cylindrical segments 43 joined to one another by hinge pins 432. The cylindrical segments 43 have recesses 431 which are used for actuating the tumbler pins of a lock with a keyway that is circular in cross-section.

The key 2E, as shown in FIG. 6C, is a modification of the key 2C illustrated in FIG. 6A. The key 2E comprises a plurality of substantially semi-circular plates 44. Each of the semi-circular plates 44 has a rear notch 444 which receives a front semi-circular projection 443 of another semi-circular plate 44. The semi-circular plates 44 are joined to one another at the rear notches 444 by transverse hinge pins 442. The surfaces of the semi-circular plates 44 similarly have a plurality of recesses 441 for actuating the tumbler pins of the lock. The transverse hinge pins 442 only allow upward or downward movement of the semi-circular plates 44, unlike that of the hinge pins 423 of the key 2C which allow only left or right movement of the rectangular plates 42 and the endmost plate 424.

As shown by the preferred embodiments, the plates which make up the body of the keys can have different sizes and shapes. The plates can be rectangular, circular, or even triangular in shape. The recesses of the key bodies are of different sizes and depths to make the locks more difficult to pick.

Figure 7A:
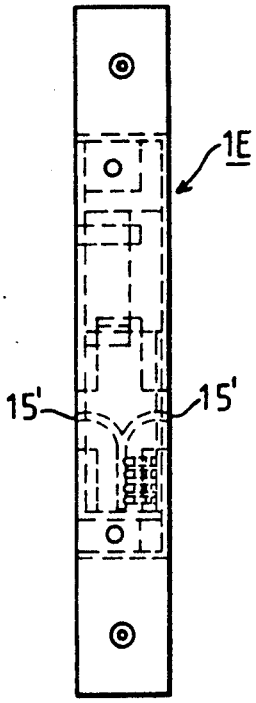
FIGS. 7A, 7B and 7C are illustrations of different locks incorporating this invention.
Figure 7B:
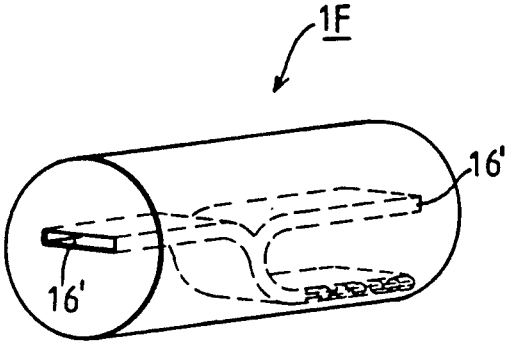
Figure 7C:
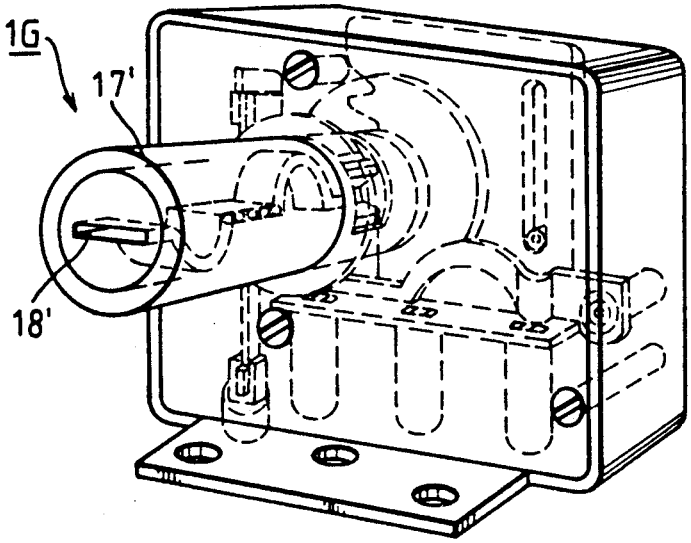

FIGS. 7A, 7B and 7C are illustrations of different locks incorporating this invention. The fourth preferred embodiment, as shown in FIG. 7A, is a door lock 1E which has no keyplug. The lock 1E has two keyholes 15' formed on two sides of the door so that the lock 1E may be operated from the inside or the outside of the door. The curved keyway is a forked keyway having an innermost portion and two oppositely directed branch portions merging with said innermost portion at an intersection point. Each of said branch portions have an accessible open end. The lock body also has an inward protrusion projecting from the intersection point in the direction of the innermost portion such that when the lock body is mounted on a door, the lock body can be unlocked from either side of the door. The fifth preferred embodiment, as shown in FIG. 7B, is a cylindrical keyplug 1F of a lock with two keyholes 16' accessible from two ends. The sixth preferred embodiment, as illustrated in FIG. 7C, is still another door lock 1G which is incorporated in a door knob 17'. The door knob 17' is provided with a curved keyway 18'.

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A key for use with a lock assembly comprising a lock body having tumbler members and a keyway curved along its longitudinal extent said key being flexible to be received in said keyway and useful for actuating said tumbler members, wherein said key has:

an inner end;

an outer end; and a plurality of one piece knuckles being hinged to one another between said inner and said outer ends, with adjacent knuckles being turnable relative to one another about individual axes, said individual axes being parallel to each other, some of said knuckles incorporating key bit projections for actuating said tumbler members.

2. A key according to claim 1, wherein said key projections are located on different knuckles.

3. A lock assembly comprising a lock body having tumbler members, a keyway curved along its longitudinal extent, and a flexible key to be received in said keyway useful for actuating said tumbler member, wherein said key has:

an inner end;

an outer end; and a plurality of one piece knuckles being hinged to one another between said inner and said outer ends, with adjacent knuckles being turnable relative to one another about individual axes, said individual axes being parallel to each other, some of said knuckles incorporating key bit projections.

4. A lock assembly comprising a lock body having tumbler members, a curved keyway, and a flexible key to be received in said keyway useful for actuating said tumbler members, wherein said key has:

an inner end;

an outer end; and a plurality of knuckles being hinged to one another between said inner and said outer ends, with adjacent knuckles being turnable relative to one another about individual axes, said individual axes being parallel to each other, some of said knuckles incorporating key bit projections;

a hollow head portion; and a plurality of hollow sections telescopically connected to said hollow head portion to serve as housing for said hinged knuckles, said hollow head portion having an elongated slide groove, one of said knuckles adjacent said inner end having a protruding button slidably engaged in said elongated groove.

5. A lock assembly according to claim 4, wherein an endmost hollow section of said telescopic hollow sections has an output opening defined by inclined edges which expose said key bit projections of said key, and a flange tip serving as a pull handle which extends outside said head portion when said telescopic hollow sections are retracted into said head portion.

6. A lock assembly as claimed in claim 3, wherein said lock body is a door lock having two opposite sides each formed with one keyhole, and said door lock can be unlocked from either of said two sides of said door lock.

7. A lock assembly as claimed in claim 3, wherein said lock body is incorporated in a door knob.

8. A lock assembly as claimed in claim 3, wherein said curved keyway is a forked keyway having an innermost portion and two oppositely directed branch portion merging with said innermost portion at an intersection point, each of said branch portions having an accessible open end, said lock body further comprising an inward protrusion projecting from said intersection point in the direction of said innermost portion, whereby when said lock body is mounted on a door, said lock body can be unlocked from either side of said door.

9. A lock assembly according to claim 3, wherein said tumbler members are actuated by key bit projections located on separate knuckles.

10. A lock assembly comprising a lock body having tumbler members and a curved keyway, and a flexible key to be received in said keyway and useful for actuating said tumbler members, wherein:

an inner end and an outer end, a plurality of knuckles movably interconnected to one another to give said key a degree of stiffness sufficient to allow said key to be inserted into said keyway, said plurality of knuckles being hinged to one another between said inner and said outer ends, some of said knuckles being formed with key bit projections, a hollow head portion, and a plurality of hollow sections telescopically connected to said hollow head portion to serve as housing for said hinged knuckles when said key is not in use, said hollow head portion having an elongated slide groove, one of said knuckles adjacent said inner end having a protruding button slidably engaged in said elongated slide groove.

11. A lock assembly as claimed in claim 10, wherein an endmost hollow section of said telescopic hollow sections has an outlet opening defined by inclined edges which expose said key bit projections of said key, and a flange tip serving as a pull handle which extends outside said head portion when said telescopic hollow sections are retracted into said head portion.

12. A lock assembly according to claim 10, wherein said tumbler members are actuated by key bit projections located on separate knuckles.

13. A lock assembly comprising a lock body having tumbler members and a curved keyway, and a flexible key to be received in said keyway and useful for actuating said tumbler members, said key having an inner end, an outer end, and a plurality of knuckles hinged to one another between said inner and said outer ends, some of said knuckles being formed with key bit projections, said knuckles giving said key a degree of stiffness sufficient to allow said key to be inserted into said keyway, said key further comprising a hollow head portion and a plurality of hollow sections telescopically connected to said hollow head portion to serve as a housing for said hinged knuckles when said key is not in use, said hollow head portion having an elongated slide groove, one of said knuckles adjacent to said inner end having a protruding button slidably engaged in said elongated groove.

14. A lock assembly according to claim 13, wherein an endmost hollow section of said telescopic hollow sections has an outlet opening defined by inclined edges which expose said key bit projections of said key, and a flange tip serving as a pull handle which extends outside said head portion when said telescopic hollow section are retracted into said head portion.

15. A lock assembly according to claim 13, wherein said tumbler members are actuated by key bit projections located on separate knuckles.

16. A key for use in a lock assembly with a curved keyway, wherein said key has an inner end and an outer end, a plurality of knuckles movably interconnected to one another to give said key a degree of stiffness sufficient to allow said key to be inserted into said keyway, said plurality of knuckles being hinged to one another between said inner and said outer ends, some of said knuckles being formed with key bit projections.

a hollow head portion, and a plurality of hollow sections telescopically connected to said hollow head portion to serve as housing for said hinged knuckles when said key is not in use, said hollow head portion having an elongated slide groove, one of said knuckles adjacent said inner end having a protruding button slidably engaged in said elongated slide groove.

17. A key according to claim 16, wherein said key projections are located on different knuckles.

18. A key for use with a lock assembly having a curved keyway, said key having an inner end, an outer end, and a plurality of knuckles hinged to one another between said inner and said outer ends, some of said knuckles being formed with key bit projections, said knuckles giving said key a degree of stiffness sufficient to allow said key to be inserted into said keyway, said key further comprising a hollow head portion and a plurality of hollow sections telescopically connected to said hollow head portion to serve as a housing for said hinged knuckles when said key is not in use, said hollow head portion having an elongated slide groove, one of said knuckles adjacent to said inner end having a protruding button slidably engaged in said elongated groove.

19. A key according to claim 18, wherein said key projections are located on different knuckles.

* * * * *